US005491538A

United States Patent [19]

Gwaltney

[11] Patent Number: 5,491,538

[45] Date of Patent: Feb. 13, 1996

[54] DEVELOPMENT APPARATUS HAVING AN ADJUSTABLE WIDTH DEVELOPMENT NIP

[75] Inventor: Mark A. Gwaltney, Fairport, N.Y.

[73] Assignee: Xerox Corporation, Stamford, Conn.

[21] Appl. No.: 270,980

[22] Filed: Jul. 5, 1994

[51] Int. Cl.[6] ..... G03G 15/08

[52] U.S. Cl. ..... 355/247; 118/656; 355/252; 355/326 R

[58] Field of Search ..... 355/247, 249, 355/252, 259, 245, 326 R; 118/654, 656

[56] References Cited

U.S. PATENT DOCUMENTS

| | | | |
|---|---|---|---|
| 3,257,223 | 6/1966 | King | 355/249 X |
| 3,257,224 | 6/1966 | Jöns et al. | 117/17.5 |
| 5,172,170 | 12/1992 | Hays et al. | 355/259 |
| 5,276,488 | 1/1994 | Schmidlin | 355/247 |
| 5,289,240 | 2/1994 | Wayman | 355/259 |
| 5,339,142 | 8/1994 | Hays | 355/259 |
| 5,386,277 | 1/1995 | Hays et al. | 355/259 |
| 5,394,225 | 2/1995 | Prker | 355/259 |

*Primary Examiner*—Nestor R. Ramirez

[57] ABSTRACT

A printing machine of the type in which a latent image recorded on an image bearing surface is developed with toner to form a visible image thereof, includes a development apparatus for developing the latent image. The development apparatus includes a housing storing a supply of magnetically-attractable developer material containing toner. A moving flexible donor belt mounted within the housing spaced from the image bearing surface transports developer to a development zone adjacent the image bearing surface. A magnetic member attracts and transports the developer material within the housing to the donor belt. A plurality of selectively-actuable electrodes embedded within the donor belt are biased to create a powder-cloud of toner particles within the development zone. Within the development zone, the flexible donor belt moves over a pair of spaced apart support rollers defining the width of the development nip. The spacing between the support rollers is adjustable to inexpensively create different widths for development nips from a common structure development unit, thereby saving image bearing member real estate within the development zone and improving the quality of image development.

17 Claims, 4 Drawing Sheets

DEVELOPMENT APPARATUS HAVING AN ADJUSTABLE WIDTH DEVELOPMENT NIP

This invention relates generally to electrostatographic reproduction machines, and more particularly concerns a scavengeless development apparatus having a belt type donor member and an adjustable width development nip.

Generally, the process of electrostatographic reproduction includes uniformly charging a photoconductive member, or photoreceptor, to a substantially uniform potential, and imagewise discharging it or exposing it to light reflected from an original image of a document being reproduced. The result is an electrostatically formed latent image on the photoconductive member. The latent image is then developed by bringing a charged developer material into contact therewith. Two-component and single-component developer materials are commonly used. A typical two-component developer material is comprised of magnetic carrier particles, also known as "carrier beads," having charged toner particles adhering triboelectrically thereto. A single component developer material typically is comprised of charged toner particles only. In either case, the charged toner particles when brought into contact with the latent image, are attracted to such image, thus forming a toner particles image on the photoconductive member. The toner particles image is subsequently transferred to a receiver sheet which is then passed through a fuser apparatus where the toner particles image is heated and permanently fused to the sheet thus forming a sheet copy of the original image.

In electrostatographic reproduction machines for making copies of highlight or full-color images, latent images of color components thereof are formed as above on a photoreceptor, and developed with different color toner particles. The color component images of different color toners may be formed as such, for example, in successive and superimposed image-on-image registration on the photoreceptor, thus forming the desired composite colored image on the photoreceptor prior to transferring to a receiver sheet. Alternatively, the color component images of different color toners may be formed as four separate toner images and then transferred successively in superimposed registration onto a receiver sheet.

A significant problem encountered particularly with performing successive image-on-image development is that a subsequent development may interfere with, or "scavenge," toner particles which had been attracted to the photoreceptor in a previous developing step. There has thus been a need for development apparatus and techniques which do not cause such interference, that is, apparatus and techniques that can be said to be "scavengeless."

One type of scavengeless development apparatus uses a donor roll for transporting charged toner particles to the development zone of the apparatus. A plurality of electrode wires are closely spaced to the donor roll in the development zone. An AC voltage is applied to the electrode wires for forming a toner cloud in the development zone. The electrostatic fields generated by the latent image attract charged toner particles from the toner cloud, thus developing the latent image.

A hybrid version of such a scavengeless development apparatus employs a magnetic brush developer roller (magnetic roller) for transporting from a sump to the donor roll, magnetic carrier beads which have charged toner particles adhering triboelectrically thereto. The charged toner particles are attracted from the carrier beads on the magnetic roller to the donor roll. In the development zone, the electrically biased electrode wires then detach the charged toner particles from the donor roll, thereby forming a toner powder cloud in the development zone for developing latent images as above.

A key variation to the powder-cloud-creation techniques which are the essence of scavengeless development is to provide electrodes, not spaced from the donor roll, but rather embedded within the donor roll. U.S. Pat. No. 5,172,170, and U.S. application Ser. No. 08/091,858 now U.S. Pat. No. 5,360,940 issued Nov. 1, 1995 both assigned to the assignee of the present application, disclose a scavengeless development apparatus each, in which a set of longitudinally-disposed electrodes are mounted on or embedded in a rotating donor roll. A contact brush is used as a commutator to energize those electrodes in the development zone of the development apparatus. When the electrodes are energized, AC electric fields are formed between adjacent electrodes. The electric fields then cause charged toner particles near the electrodes to jump off the donor roll, thus forming the powder cloud for latent image development within the development zone.

U.S. Pat. No. 3,257,224 discloses an apparatus for developing electrostatic images in which a developer roller transports both toner and a magnetic carrier. The roller is made up of rotor plates having windings to which current is supplied intermittently, and an outer cover of an insulating plastic material. The purpose of the electromagnetic windings within the roller is to attract developer material from a sump to the surface of the roller. The electromagnetism is cut off only to clean the roller and recycle the developer, after the given portion of the surface exits the development zone.

In roller-type scavengeless development apparatus as above, one disadvantage encountered is that the width of the development nip is limited to the footprint of the roller against the image bearing surface. The distance of the developer material sump from the development zone is also limited by the diameter of the rolls, and the biasing schemes are stacked and complicated in order to avoid electrical field interference, for example, within the development zone.

Another significant disadvantage encountered in multicolor machines is non-uniform development when performing multiple, successive development steps with toner particles of different colors, for example, cyan, magenta, yellow and black toner particles, each of which may have different development characteristics. One result of the different characteristic of yellow toners is that the human eye is less sensitive to yellow toners. As such, high quality development using yellow toners ordinarily requires less yellow toner mass per developed area than do other color toners. In addition, the sizes of toner particles, as well as the charge-to-mass ratios for toner particles of each color may also be significantly different. If not compensated for, such differences can result in non-uniform image development. Therefore, in addition to addressing the "scavenging" disadvantages as above with electroded development, there is also a need for addressing poor, non-uniform development associated with differences among tone, and toner development characteristics.

A still further disadvantage associated with development apparatus performing multiple color toner development steps is that of limited space or limited real estate on the image bearing member for positioning of multiple development apparatus and other electrostatographic process components in the development zone of a reproduction machine. There is therefore an obvious need to inexpensively make the width of the development nip of each developer member only as large or as small as necessary in order to preserve such real estate space.

SUMMARY OF THE INVENTION

In accordance with one aspect of the present invention, there is provided a printing machine of the type in which a latent image recorded on a surface is developed with toner to form a visible image thereof. The printing machine includes a housing that defines a chamber storing at least a supply of toner therein, and a moving flexible donor belt, that is mounted in the housing and spaced from the surface, to transport toner from the chamber of the housing to a development zone adjacent the surface. The printing machine also includes an electrode member that is integrated with the flexible donor belt and adapted to move therewith. The electrode member is electrically biased to detach toner from the flexible donor belt to form a cloud of toner in the development zone for developing the latent image.

In accordance with another aspect of the present invention, there is provided a development apparatus for developing a latent image recorded on an image bearing surface. The development apparatus includes a housing for storing a supply of magnetically-attractable developer material. A moving flexible donor belt is mounted within the housing and is spaced from the image bearing surface for transporting toner particles to a development zone adjacent the image bearing surface. A magnetic member mounted within the housing attracts and transports the developer material from a sump of the housing to the donor belt. A plurality of selectively-actuable electrodes embedded within the donor belt create a powder-cloud of toner particles when actuated within the development zone. Within the development zone, the flexible donor belt moves over a pair of spaced apart support rollers that define the width of the development nip. The spacing between the support rollers is adjustable so as to inexpensively create development units having development nips of different and adjustable widths from a common development unit.

In accordance with still another aspect of the present invention, there is provided a color electrostatographic reproduction machine including an image bearing member and means for electrostatically forming a first and at least a second latent images on the image bearing member. The reproduction machine further includes a plurality of development units each containing a different type of toner particle for developing the latent images. The plurality of development units includes at least first and second development units. The first development unit contains a first type of toner particle and includes a belt donor member forming a first development nip having a first nip width. The second development unit contains a second type of toner particle and includes a belt donor member forming a second development nip having a second nip width greater than the width of the first development nip.

BRIEF DESCRIPTION OF THE DRAWINGS

Other features of the present invention will become apparent as the following description precedes and upon reference to the drawings, in which.

DETAILED DESCRIPTION OF THE INVENTION

Figure 4:
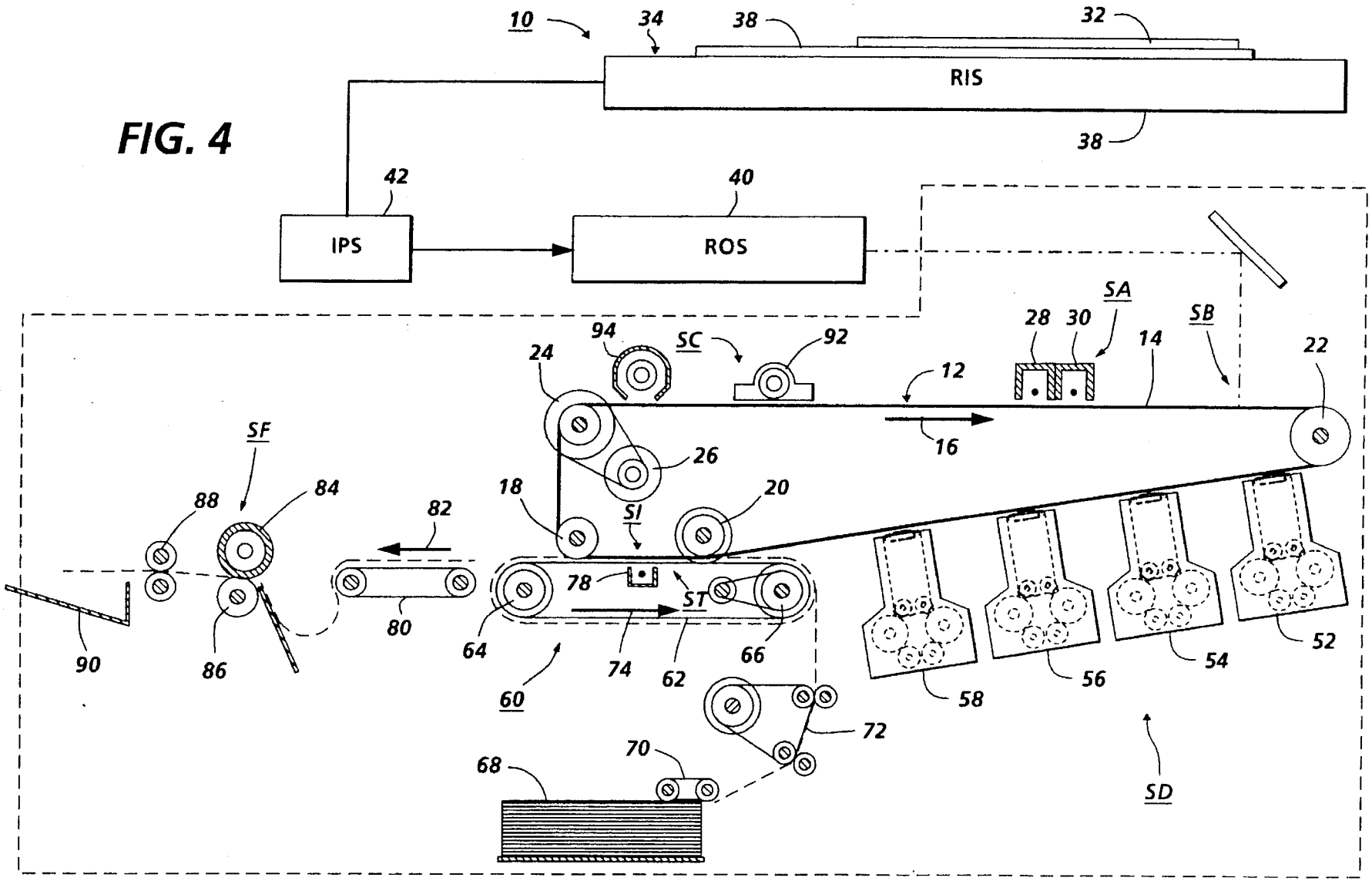
FIG. 4 is a schematic elevational view of an exemplary color electrostatographic reproduction machine incorporating a plurality of development units according to the present invention.

Referring first to FIG. 4, there is shown an exemplary electrostatographic reproduction machine 10 including an image bearing member 12, such as a photoconductive belt. Belt 12 has an image bearing surface 14, and is moved along a path of movement and in a direction as shown by the arrow 16 in order to advance successive portions of its photoconductive surface sequentially through various processing stations disposed about such path of movement. As illustrated, belt 12 is entrained about a series of rollers including transfer rollers 18 and 20, tensioning roller 22, and a drive roller 24. Drive roller 24 is rotated by a motor 26 coupled thereto by suitable means such as a belt drive.

Initially, a portion of the photoconductive surface 14 of belt 12 passes through a charging station SA where two corona generating devices 28 and 30, appropriately charge the surface 14 of such portion to a relatively high, and substantially uniform potential. Corona generating device 28 for example places all of its required charge on photoconductive surface 14 of belt 12, and corona generating device 30 acts as a leveling device by filling in any areas missed by corona generating device 28.

Next, the charged potion of the photoconductive surface 14 of belt 12 is moved to an exposure station SB where a document 32 containing a color original image is positioned on a transparent platen 34. The exposure station SB also includes a raster scanning system 36 which for example is comprised of a raster input scanner (RIS) 38, a raster output scanner (ROS) 40, and an image processing system (IPS) 42. The RIS 38 scans the color original image of document 32 one line at a time and generates signals that are each representative of at least one color component of the color original image of document 32. The RIS thus can capture the entire color original image of the document 32, and convert it to a series of raster scan lines which are then transmitted as electrical signals to IPS 42. As is well known, these electrical signals correspond, for example, to red, green and blue intensities at each scanned point of the original color image. The IPS takes the signals as such and processes them into proper cyan, magenta, yellow and black signals which are then transmitted to ROS 40. ROS 40 which includes a laser with a rotating polygon mirror (not shown), imagewise illuminates a charged portion of the photoconductive surface of belt 12 for processed signals of each color type. Such illumination thus selectively discharges areas of a charged portion of the photoconductive surface 14, thereby selectively recording four electrostatically formed latent images on four such charged portions of the photoconductive surface. The four latent images as such correspond to cyan, magenta, yellow and black color components of the color original image of document 32.

After the recording of the latent color component images, the belt 12 advances the latent images sequentially to a development station SD for development by units according to the present invention. As shown, development station SD includes four individual development units according to the present invention which are indicated generally by the reference numerals 52, 54, 56 and 58 (to be described in detail below). The development units 52, 54, 56 and 58 are each of a type generally referred to in the art as "hybrid scavengeless" development units. Typically, a hybrid scavengeless development unit includes a housing containing a magnetizable developer material including magnetic carrier beads having toner particles adhering triboelectrically thereto for latent image development. In such a unit, the developer material is triboelectrically charged in a mixing chamber, and continually brought into a toner particles transfer relation with a donor. Development is achieved by means of the donor member transporting the toner particles through a development nip, and into contact with a latent charge image on the photoconductive surface 14 of belt 12. As is well known, in color electrostatographic reproduction, the development units 52, 54, 56 and 58 each contain developer material having toner particles of a different color.

Although the development units of the present invention are being described with reference to toner particles, and hence dry developer materials, it is understood that the development apparatus concepts of the present invention are equally applicable to development units employing liquid developer materials, and hence liquid toner. As such, reference in the description to toner particles equally applies to liquid toners, and references in the claims to toner, include both dry and liquid toners.

The different color toner particles in each unit are adapted to absorb light within a preselected spectral region of the electromagnetic wave spectrum for developing color component latent images. For example, the color component latent image formed by discharging areas using signals processed from green signals from the RIS 38, is developed or made visible by developer unit 52 with green absorbing (magenta) toner particles. Similarly, areas discharged using signals processed from blue signals from the RIS 38 are developed by developer unit 54 with blue absorbing (yellow) toner particles, while areas discharged using signals processed from red RIS signals are developed by developer unit 56 with red absorbing (cyan) toner particles. Development units 52, 54 and 56 therefore, respectively, contain and use toner particles of an appropriate color corresponding to the complement of the particular color of the latent color component image recorded by ROS 40 on the photoconductive surface 14 of belt 12. On the other hand, development unit 58 contains black toner particles, and is used to develop the recorded latent image component corresponding to gray and black regions of the color original image of document 32. Such development, as is well known, results in four different color toner images.

Figure 3:
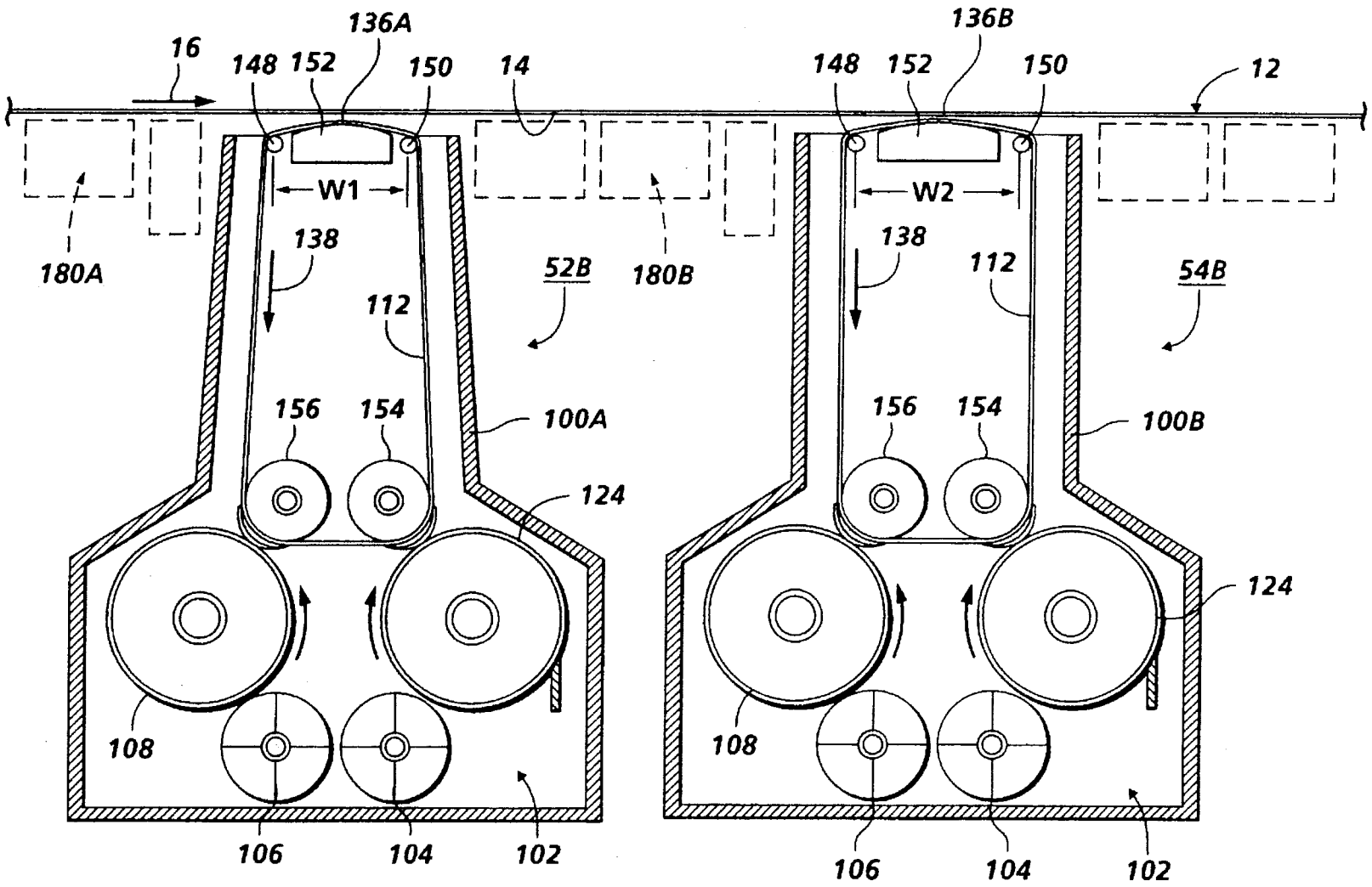
FIG. 3 is a schematic elevational view of a part of the development system of a color electrostatographic reproduction machine, showing two development units according to the present invention having two adjusted, different and unequal development nip widths.

As can be appreciated by those skilled in the art, the four color component toner images may alternatively be formed image-on-image in superimposed registration with each other on a single imaging frame or portion of the surface 14 (FIG. 3). The particular electrostatographic process for such image-on-image formation, of course, requires an IPS such as 42, and an upstream RIS and ROS assembly such as 180A, 180B (FIG. 3) for each development unit.

Referring still to FIG. 4, each of the development units 52, 54, 56 and 58 is mounted so as to be movable into and out of an operative development position with a latent image on the surface 14 of the image bearing member 12. In a non-operative position, each unit is spaced from the photoconductive surface 14 of the image bearing member. During development of each electrostatic latent image, only one development unit is in the operative position, the remaining development units are in the non-operative position. This insures that each electrostatic latent image is developed only with toner particles of the appropriate color, without comingling. In FIG. 4, development unit 52 for example is shown in the operative position with development units 54, 56 and 58 being in the non-operative position. Alternatively too, all four units may each have an operative mode as well as an inoperative mode depending on whether or not a development bias source (to be described below) is turned on or off. In this alternative, all four stations instead of being moved towards and away, may actually be spaced the same distance, from the image bearing surface 14.

After development by the units 52, 54, 56 and 58, the four different toner images are moved sequentially to a transfer station ST where the images are transferred to a sheet of support material, such as copy sheet of paper. At the transfer station ST, a sheet transport assembly 60 moves a sheet into contact with the photoconductive surface 14 of belt 12. Sheet transport assembly 60 for example has a pair of spaced belts 62 that are entrained about a pair of rolls 64 and 66. A copy sheet is gripped and advanced by a belt 70 from a stack 68 of such sheets, and onto a conveyor 72. Conveyor 72 then advances the copy sheet in synchronism with the movement of a gripper to sheet transport assembly 60. In this way, the leading edge of the sheet is certain to arrive into contact with the photoconductive surface 14, in synchronism with a toner images thereon, even as the belts are moving in the direction of arrow 74. At transfer station ST, a corona generating device 78 sprays ions onto the backside of the copy sheet so as to charge the sheet to an appropriate polarity and magnitude for attracting the toner image from photoconductive surface 14. As is well known, for transferring color component toner images so as to form a composite color copy of a color original, the copy sheet remains secured to the gripper so as to move in a recirculating path for four cycles, each cycle including a toner image transfer operation as described above. In this way, the cyan, yellow, magenta and black component color toner images can be transferred to the sheet in superimposed registration with one another to form a multi-color copy of the color original image of document 32. As is also well known, the color component toner images may alternatively be formed image-on-image on a single frame or portion of the photoconductive surface (FIG. 3) with charging and exposing steps being carried out before each development operation as above. As such, the transfer step at transfer station ST merely involves a single pass of the sheet and a single transfer of the composite image onto the sheet.

After the toner image transfer operation, the copy sheet is released from the surface 14, and transported by a conveyor 80 in the direction of arrow 82 to a fusing station SF. At fusing station SF, the composite color toner image is heated and permanently fused to the copy sheet. Fusing station SF as shown, typically includes a heated fuser roll 84 and a pressure roll 86. The copy sheet is passed through a fusing nip defined by fuser roll 84 and pressure roll 86 such that the composite color toner image contacts fuser roll 84. Thereafter, the sheet is advanced by a pair of forwarding rolls 88 to output tray 90, for subsequent removal by an operator.

The last processing station of the machine 10 is a cleaning station SC for preparing the photoconductive surface 14 of belt 12 for another imaging cycle. At cleaning station SC, a rotatably mounted fibrous brush 92, for example, is positioned and maintained in rotatable contact with photoconductive surface 14 of belt 12 so as to remove residual toner particles remaining thereon after the toner image transfer operations. Additionally, a lamp 94 may illuminate photoconductive surface 14 in order to remove any residual charge remaining thereon from the just completed imaging cycle.

Figure 1:
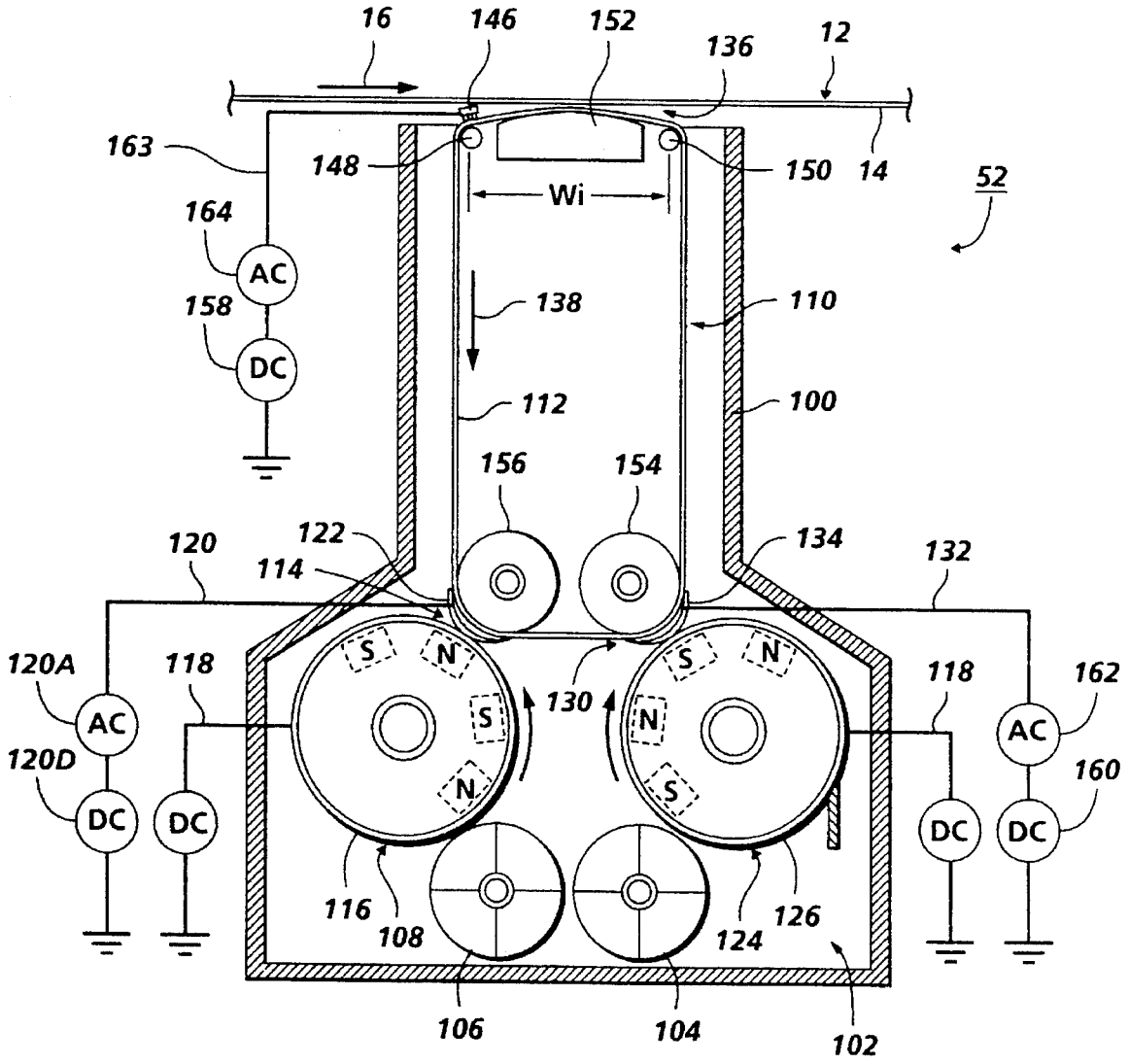
FIG. 1 is a schematic elevational view (partly in section) showing the development unit of the present invention.

Referring now to FIG. 1 an improved scavengeless non-interactive development unit, such as unit 52 (FIGS. 4), according to the present invention is illustrated. Since the features of the development units 52, 54, 56 and 58 (FIG. 4) and 52A, 54B (FIG. 3) of the present invention are the same for each unit, only one such unit, 52, will be described in detail. As shown, development unit 52 includes a housing 100 defining a mixing chamber 102 for mixing and charging a supply of magnetizable two-component developer material. The developer material typically is a two-component developer material comprising at least ferrous or magnetizable carrier beads and pigmented polymer toner particles. The developer material is moved and mixed within the mixing chamber 102 by developer material means mounted within the mixing chamber. The developer material moving means for example include mixing devices such as augers 104, 106. Such moving and mixing of the developer material oppositely and triboelectrically charges the carrier beads and toner particles respectively. As a consequence of such charging, the oppositely charged toner particles adhere triboelectrically to the charged magnetizable carrier beads.

The development unit 52 also includes a spent toner particles removing or cleaning roll 108 for removing spent toner particles from a toner transport assembly 110 which includes the belt donor member 112 of the present invention (to be described in detail below). Cleaning roll 108, for example, is a magnetic roll that includes a stationary multi-polar magnetic core inside a rotating aluminum shell 116 cleaning roll 108 is mounted within the chamber 102 so as to form a cleaning nip 114 with the belt donor member 112. As shown, the conductive shell 116 cleaning roll 108 is grounded or biased by a DC source 118. In the cleaning nip 114, a portion of the belt donor member 112 is biased appropriately by a source 120, through a commutator device 122. The bias source 120 includes an AC bias 120A and a DC bias 120D, and is such that, relative to the bias source 118 of the shell 116, toner particles on the belt donor member 112 will be attracted onto the shell 116, thereby cleaning a portion of the belt donor member.

The development unit 52 further includes a developer material feeder or magnetic roll 124 that is disposed interiorly of the mixing chamber 102 for feeding a quantity of developer material from the chamber to the belt donor member 112. The magnetic roll 124, for example, includes a stationary multi-polar magnetic core inside a rotating aluminum shell 126. The shell 126 also is biased by a DC source 118. As shown, the feeder magnetic roll 124 is mounted in close proximity to the belt donor member 112 and forms a toner-transfer or loading nip 130 therewith. In the loading nip 130, a portion of the belt donor member 112 is biased by a source 132 through a commutator device 134. The bias source 132 includes an DC bias 160 and an AC bias 162, and is such that, relative to the bias source 128 of the shell 126, toner particles on the shell 126 will be attracted onto the surface of the belt donor member 112, thereby loading a portion of the donor member with such charged toner particles. As also shown, mixing devices, such as the horizontal augers 104, 106, are provided within the mixing chamber 102 for moving and distributing developer material uniformly along the length of magnetic roll 124 for example. In each case, as each shell 115, 126 rotates, developer material is magnetically attracted from the augers 104, 106 onto the outer surface of such shell. The attracted developer material which preferably is trimmed by a trim bar (not shown) to a specified thickness, is carried on the shell and transported around with the shell into contact with a portion of the belt donor member 112 in the toner transfer nips 114, 130, respectively.

Figure 2A:
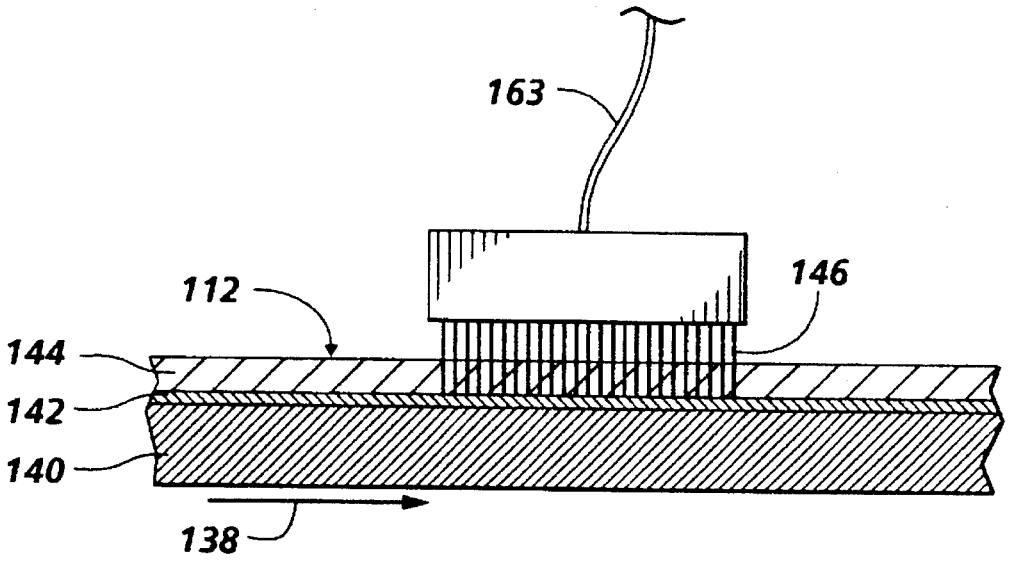
FIG. 2A is an in-track sectional view of a segment of the electroded donor belt showing a commutator brush in the development nip region of the development unit of FIG. 1.
Figure 2B:
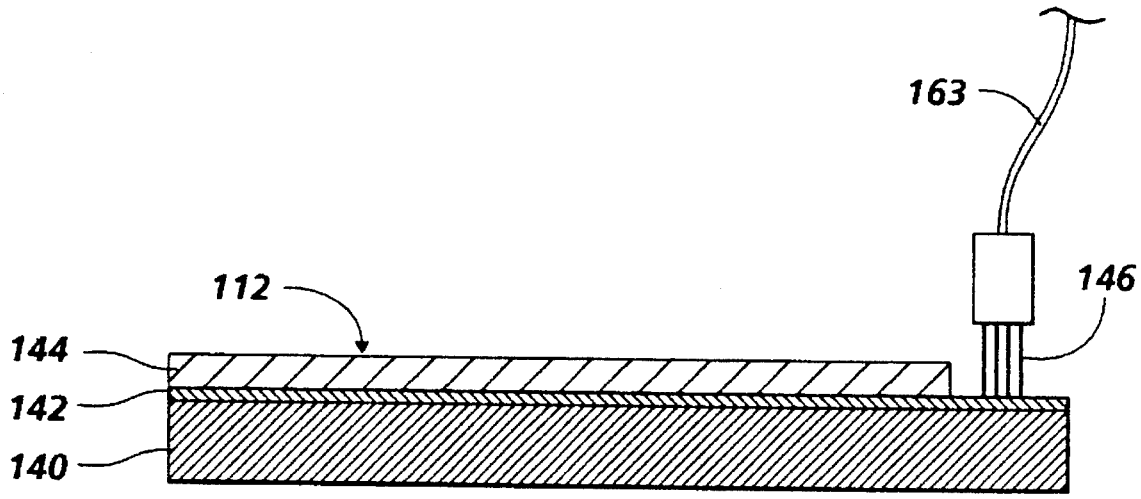
FIG. 2B is a cross-track sectional view of the segment of FIG. 2A.

Referring now to FIGS. 1 to 2B, the toner transport assembly 110 importantly includes the belt donor member 112 of the present invention. As illustrated, belt donor member 112 advantageously forms an adjustable width development nip 136 with the image bearing member 12 and is movable in the direction of the arrow 138, to transport toner particles into and through the development nip 136. Belt donor member 112 (FIGS. 2A and 2B) preferably includes a non-conductive backing 140, and an embedded layer of biasable conductive segments or strips 142. It also includes a dielectric surface layer 144 that is formed over the embedded conductive segments or strips 142. As shown, the conductive strips 142 as embedded, each run widthwise through the belt donor member 112, and additionally are spaced and electrically isolated along a closed loop length of the donor member. In order to allow contact by a commutator device 146 with the biasable strips 142, the dielectric layer 144 extends only a part of the way relative to one of the edges of the belt donor member 112. The non-conductive backing 140 is movable against a plurality of backing support members, such as rollers 148, 150. Additionally, the non-conductive backing 140 is comprised of MYLAR a trademark of DuPont(UK)Ltd. for polyester film, and advantageously functions to direct substantially all development biasing electric field lines from the biased conductive strips 142 into the development nip 136, thereby increasing the rate and quality of development.

Referring still to FIG. 1, the belt donor member 112 of transport assembly 110 is movable in a direction as shown by the arrow 138 through the cleaning nip 114 where it is cleaned. After that, belt donor member 112 receives charged toner particles fed thereto within toner -transfer nip 130, and then transports such toner particles to and through the development nip 136. The toner transport assembly 110 as shown includes a plurality of backing support members, such as a contoured back plate 152 for spacing a portion of the belt donor member 112 from the image bearing member 12 within the development nip 136. The toner transport assembly 110 also includes first and second back up rollers 148, 150 that are mounted for training a portion of the belt donor member 112 across the development nip 136. According to one advantageous aspect of the present invention, the second back up roller 150 is adjustable relative to the first back up roller 148 in order to vary or adjust the width "Wi" of the development nip 136.

As such, the width "Wi" of the development nip 136 formed by the belt donor member 112 can be adjusted for optimum performance depending on the requirements of a host machine. For example, in a machine having a photoconductive belt type image bearing member, the belt donor member 112 can be held substantially parallel to the photoconductive belt within the development nip area, thus resulting in a wider and more uniform development nip 136. Such an extended nip as can be expected, produces better developed images than short development nips. Also, since the belt donor member spacing from the image bearing member 12 is defined by a backer bar or backing support plate 152, run-out of the donor member as occurs with donor rolls is not an issue.

Furthermore, the capability according to the present invention to adjust the width "Wi" of the development nip 136 is valuable because it conserves image bearing member or photoreceptor real estate in the development nip area by making the width "Wi" only as wide as is necessary for perceived quality development. Depending on the color or particle size of the toner particles in the developer material being used, for example, some development units may require a wider or narrower width development nip in order to achieve a desired level of perceived quality image development. According to the present invention, given a common structure development unit having the ability for nip width adjustment, development units that require wider width development nips can be provided from such a common structure type unit by increasing the distance between the first and second back support rollers 148, 150. On the other hand, development units that do not require wide development nips can also be provided from the common structure type unit by narrowing the distance or free space between such rollers 148, 150.

One of the reasons for including development units having different size nip widths in a reproduction machine, for example, involve DMA or Developed Mass/Area requirements. In color process reproduction machines for example, toner particles of some colors such as yellow toner particles may not have the same DMA requirements in order to achieve perceived uniform quality development as compared to that from toner particles of the other colors. This is because in the case of yellow toners, smaller masses of the yellow toners can be used per unit area, since the human eye is less sensitive to yellow. As such, DMA variations due to a narrow width development nip in a yellow toner development unit would likely not be perceived. Another reason for including development units having different size nip widths in a reproduction machine, involves toner particle size. In a multi-color process machine, the different color toners often do have different particle sizes. Typical toner particle sizes can range from 5 to 15 μm. Such differences can be by design, since smaller size toner particles are more expensive to produce. In such machines, since the ability of a toner to effect development is a function of its particle size, larger particle size toners will not require as wide a development nip as smaller particle size toners in order to provide a satisfactory mass of such toners per developed unit area. Thus, according to the present invention, development units having yellow toner or larger particle size toners can be provided with adjusted narrower width development nips.

A final reason for including development units having different size nip widths in a reproduction machine, involves the inherent differences between developer materials in their ability to develop. By design, developer materials may contain different additives for charge control, flow control, pigment color, or other reasons. These differences ordinarily make each developer material behave slightly differently from the others, thus often requiring different development unit characteristics for meeting uniform quality development expectations. According to the present invention, such development unit characteristics include the width of the development nip. Advantageously, photoreceptor real estate saved by adjusting the development nips according to the present invention can desirably result in small and more compact machines, or in machines including more desired components.

Referring still to FIG. 1, at least a third back up roller 154, and a fourth back up roller 156 of the toner transport assembly 110 are mounted adjacent the mixing chamber 102 for training the belt donor member 112 through a toner-transfer relation with the developer material moving rolls 108, 124. In order to reduce costs by standardizing a length for the belt donor member 112 in a common structure development unit of the present invention, the at least third and fourth back up rollers 154, 156 respectively are mounted therein spaced adjustably from a line (not shown) connecting the first and second back up rollers 148, 150 thereof.

As further shown in FIG. 1, the belt donor member 112 is biased within the toner transfer nip 130 to a specific voltage, by the source 132 that includes a DC power supply 160 for enabling the donor member 112 to attract charged toner particles off of the magnetic roll 124. The bias source 132 also includes an AC voltage source 162 that functions to temporarily loosen the charged toner particles on the magnetic roll 124 from their adhesive and triboelectric bonds to the charged magnetized carrier beads thereon. Loosened as such, the toner particles can then be attracted more easily to the donor member 112 AC voltage source 162 can be applied either to the belt donor member 112 as shown in series with DC source 160, to the magnetic roll 124.

Within the development nip 136, a commutator device, such as a brush 146 of carbon or metal fibers, selectively contacts and biases the conductive strips 142 of the belt donor member then moving through the development nip 136. The commutator brush 146 is biased appropriately by a source 163 that includes an AC source 164. AC source 164 serves to loosen charged toner particles from the surface of the belt donor member 112, as well as, to form a cloud of such loosened toner particles within the development nip 136. The bias source 163 also includes a DC bias 158 for enabling the directional transfer of charged toner powder cloud form the belt donor member 112 to the charged latent image on surface 14.

Referring now to FIG. 3, a section of an image-on-image color process reproduction machine is shown and includes two development units 52A, 54B mounted so as to each form a development nip 136A, 136B respectively with a photoreceptor, such as the image bearing member 12. As shown, the first development unit 52A has a first housing 100A containing toner particles of a first type or color for developing a first latent image of a first color component of an original color image on the image bearing member 12. For the reasons explained above, for example, the first type or color of toner particles can be larger particle size toners(compared to those in the second development unit 54B), or yellow toner. In accordance with the present invention, the first development unit 52A advantageously includes a belt donor member 112 that is mounted within its housing, and forms a first development nip 136A with the image bearing member 12, such that the nip 136A has a first width "W1" thereto. The second development unit 54B similarly has a second housing 100B containing toner particles of a second type or color for developing a second latent image of a second color component of an original color image on the photoreceptor 12. The second development unit 54B includes a belt donor member 112 that is mounted within its housing 100B, and forms a second development nip 136B with the image bearing member 12, such that the nip 136B has a second width "W2". According to the present invention, the second width W2 of the second development nip 136B is advantageously made greater than the first width "W1" of the first development nip 136A, in order to produce satisfactory perceived uniform quality development from the different toners of the first and second development units 52A, 54B.

In such an image-on-image color process reproduction machine, electrostatographic process devices, such as charge corotrons or exposure ROSes shown as 180A, 180B, respectively, can be mounted appropriately upstream of the developer units 52A and 54B. As described above, each of the development units 52A, 54B according to the present invention includes elements for adjusting the width of its development nip. These elements for example include first and second guide or back up rollers 148, 150 that are adjustably spaced apart relative to each other, and thus define for each unit a spacing for mounting various size backer bars or plates 152. The additional back up rollers 154, 156 for training the belt donor member within the mixing chamber 102 of each unit, are also adjustable vertically relative to a line (not shown) connecting the first and second back up rollers 148, 150, thus allowing for the use of a common length belt donor member 112.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. In a color electrostatographic reproduction machine having an image bearing member, a development system for developing latent images of color components of a color original image recorded on the image bearing member, the development system including:

(a) a first development unit including a first housing storing a developer material containing toner of a first color for developing a first latent image of a first color component, said first development unit having a belt type first donor member mounted within said first housing and forming a first development nip with the image bearing member, said first development nip having a first width thereto; and (b) a second development unit including a second housing storing a developer material containing toner of a second color for developing a second latent image of a second color component, said second development unit having a belt type second donor member mounted within said second housing and forming a second development nip with the image bearing member, said second development nip having a second width thereto greater than said first width of said first development nip, for enabling uniform quality development from both said first and said second development nips.

2. The development system of claim 1, including third and fourth development units each having a belt type donor member forming an additional development nip with the image bearing member, each said additional development nip having a width thereto substantially equal to said second width of said second development nip.

3. The development system of claim 1, wherein said toner particles of first color in said first development unit comprise yellow toner particles.

4. The development system of claim 1, wherein said developer material stored in said first development unit includes toner particles each having an average size substantially greater than that of toner particles included in said developer material stored in said second development unit.

5. A development unit for developing a latent image recorded on an image bearing member, the development unit comprising:

(a) a housing storing a supply of magnetizable two-component developer material containing toner particles;

(b) means mounted within said housing for moving developer material thereabout; and (c) a toner transport assembly including:

(i) a movable belt donor member forming a development nip with the image bearing member and transporting toner particles into and through said development nip for latent image development;

(ii) a contoured back supporting plate located across said development nip for spacing said belt donor member from the image bearing member; and (iii) first and second back up rollers mounted for training a portion of said belt donor member across a width of said development nip, said second back up roller being movable relative to said first back up roller to vary said width of said development nip.

6. The development unit of claim 5, wherein said toner transport assembly includes at least a third back up roller mounted within said housing for training said belt donor member through a toner-transfer relation with said developer material moving means.

7. The development unit of claim 5, wherein said belt donor member includes an embedded layer of selectively biasable conductive strips.

8. The development unit of claim 5, wherein said developer material moving means within said housing includes first and second magnetic rollers biased appropriately for loading and for removing respectively, charged toner particles relative to said belt donor member.

9. The development unit of claim 6, wherein said toner transport assembly further includes a fourth back up roller mounted spaced from said at least third back up roller for training said belt type donor member through said toner-transfer relation with developer material moving means.

10. The development unit of claim 5, wherein said at least third back up roller is mounted spaced adjustably from a line connecting said first and said second back up rollers.

11. The development unit of claim 7, wherein said belt donor member further includes a non-conductive backing underneath said embedded layer of conductive strips.

12. The development unit of claim 11, wherein said belt donor member includes a dielectric surface layer formed over said embedded layer of conductive strips.

13. A color reproduction machine including:

(a) an image bearing member;

(b) means for electrostatically recording a first and at least a second latent images on said image bearing member; and (c) a plurality of development units each storing developer material containing a different type of toner for developing said latent images on the image bearing member, said plurality of development units including:

(i) a first development unit containing a first type of toner for developing said first latent image, said first development unit having a movable first belt donor member forming a first development nip with the image bearing member and a first set of back up rollers defining a first width of said first development nip; and (ii) a second development unit containing a second and different type of toner for developing said at least second latent images, said second development unit having a second belt donor member forming a second development nip with the image bearing member and a second set of back up rollers defining a second width for said second development nip, and said second width of said second development nip being unequal to said first width of said first development nip.

14. The color reproduction machine of claim 13, wherein said second width of said second development nip is greater than said first width of said first development nip.

15. The color reproduction machine of claim 13, wherein said first and said second belt donor members each include embedded biasable conductive strips, and a non-conductive backing formed underneath said conductive strips for directing substantially all development biasing electric field lines from said biasable conductive strips into the development nip thereof.

16. The color reproduction machine of claim 13, wherein said first type of toner in said first development unit comprises yellow toner.

17. The color reproduction machine of claim 13, wherein said first type of toner in said first development unit comprises dry toner particles having an average particle size greater than that of dry toner particles of said second type of toner.

* * * * *